United States Patent [19]

Peterson

[11] Patent Number: 4,503,870

[45] Date of Patent: Mar. 12, 1985

[54] COIFFURE STYLING PROP

[76] Inventor: Luetta M. Peterson, P.O. Box 1247, Kankakee, Ill. 60901

[21] Appl. No.: 540,364

[22] Filed: Oct. 11, 1983

[51] Int. Cl.[3] ..... A45D 8/26

[52] U.S. Cl. ..... 132/9; 132/48 R

[58] Field of Search ..... 132/9, 46, 48, 40, 32

[56] References Cited

U.S. PATENT DOCUMENTS

| | | | |
|---|---|---|---|
| D. 207,146 | 3/1967 | Bulbarelli et al. | D28/35 |
| 1,618,385 | 2/1927 | Pearson | 132/48 A |
| 2,095,802 | 10/1937 | Engelke | 132/41 A |
| 2,292,176 | 8/1942 | Tate | 16/225 |
| 2,699,789 | 1/1955 | Goodman | 132/48 R |
| 2,847,016 | 8/1958 | Rabinowitz | 132/48 R |
| 3,191,255 | 6/1965 | Nealis | 24/401 |
| 3,198,196 | 8/1965 | Sawin | 132/9 |
| 3,323,208 | 6/1967 | Hurley, Jr. | 30/124 |
| 3,412,739 | 11/1968 | Thatcher | 132/48 R |
| 3,428,057 | 2/1969 | Braskamp | 132/36 C |
| 3,494,072 | 2/1970 | Olson | 47/44 |
| 3,595,249 | 7/1971 | Solomon | 132/48 R |
| 3,618,161 | 11/1971 | Nozawa | 16/227 |
| 3,662,767 | 5/1972 | Murtha | 132/9 |
| 3,805,810 | 4/1974 | Savala | 132/9 |
| 3,900,550 | 8/1975 | Oliver et al. | 264/320 |
| 4,117,575 | 10/1978 | Heimberger | 24/401 |
| 4,255,872 | 3/1981 | Williams, Sr. | 434/308 |
| 4,290,174 | 9/1981 | Kalleberg | 24/444 |

FOREIGN PATENT DOCUMENTS 1511903 5/1978 United Kingdom .

*Primary Examiner*—Gregory E. McNeill

*Attorney, Agent, or Firm*—Lee, Smith & Zickert

[57] ABSTRACT

A coiffure styling device having a pair of elongate body member halves hingeable by a perforated hinge along adjacent elongate edges thereof for closing the device around strands of hair. Attached along the free elongate edges of the body member halves by stems are complementary hemispherical nodules with rounded camming surfaces and flat engaging surfaces which snap-lock together when the body member halves are hinged to a closed portion. At one or both ends of each body member half is formed a flange flared outwardly to form a base of expanded surface area to support the styling device diametrically outwardly from the scalp of a person. On the inner faces of each body member is a groove for accommodating the hair strands and for containing adequate styling fluids.

10 Claims, 10 Drawing Figures

COIFFURE STYLING PROP

BACKGROUND OF THE INVENTION

The present invention relates generally to hair treatment, dressing or styling devices, and particularly to devices which are snap-lockable around one or more strands of hair to permit isolation and treatment thereof.

There is an ever-present need for hair dressing aids which simplify treatment and reduce the time required to treat hair, especially treatments such as frosting and streaking where only selected portions of the hair are to be styled.

It is a well-known practice to utilize perforated rubber caps which are placed over a person's head, and where the hair strands are then indiscriminately pulled through the holes with a hooked instrument. While this technique has realized a certain degree of commercial success it is nonetheless a very painful experience when the cap is removed as it must be pulled over the many strands of hair. Once the cap is removed, it is very difficult to touch-up hair strands which were missed or incompletely colored. Another shortcoming of the perforated cap is that the hair strands to be colored or otherwise treated must be those which lie immediately below the perforated holes. Since the holes are uniformly distributed over the surface of the cap no provision is made for increasing the number of strands treated per unit area, nor for treating only a portion of the strands.

It is also known in the art that hair strands can be selectively isolated by wrapping metal foil strips therearound. This method also is somewhat effective, but suffers the disadvantage that it is extremely time consuming and the foil tends to loosen unless secured therearound by a rubberband, which only adds to the time and complexity of the styling operation.

Other hair styling devices include the hair straightening clamp of U.S. Pat. No. D. 207,146 which discloses elongate members hingeable along adjacent elongate edges and clampable together around hair strands with no less than four separate locking elements used to keep the clamp attached to the strands of hair. The obvious disadvantage of such device is that each locking element must be individually applied and removed—a very time consuming procedure when perhaps 40–50 clamps may be required for achieving a particular coiffure.

There is therefore a need for a one-piece device which, once the operator has isolated the strands of hair, clamps to the hair strands by simply snap-locking the device on the strands by simple finger pressure. To facilitate hair dressing operations, such as frosting or streaking, there is also a need for a hair styling device which maintains different locks of hair strands separated by supporting each lock diametrically outwardly from a person's scalp.

SUMMARY OF THE INVENTION

The coiffure styling prop according to the invention provides the capability for quickly, easily and economically attaching the styling prop to hair strands and thereby perform hair treatment operations on such strands. The styling prop comprises a pair of lightweight body members integrally united along adjacent elongate edges by a living hinge so that such members can be used repeatedly and folded to a closed position to capture strands of hair therebetween. Along the elongate free edges of the body members are integrally formed snap-lock means for locking the body members together when pressed to a fully closed position around the strands of hair.

In the preferred embodiment of the invention the living hinge is perforated so that the device is highly flexible and thus easier to fold around hair strands. The perforations in the living hinge enhance the flexibility and the durability of the hinge. Additionally, the snap-lock means comprises a plurality of hemispherical nodules formed along each free edge of the respective body members and disposed such that opposing nodules initially slideably engage along their rounded camming surfaces, and finally snap into a locking engagement through contact with their flat surfaces.

The hair styling prop also includes a flange around one end of each body member. The flange is flared outwardly to form a base of expanded area for supporting the prop on the scalp so that it is capable of being self-supporting diametrically outwardly from the scalp.

In an alternative form of the invention a flanged base is provided at both ends of the body member halves to facilitate stacking multiple hair props on a lock of hair strands. In yet another variation the inside faces of the body member halves include an elongate concave depression for holding adequate hair dressing fluids.

Because of the unique structure of the styling prop it can be folded around hair strands and clamped with one hand, while the other hand of the operator is free to select and hold the strands of hair.

DETAILED DESCRIPTION OF THE PREFERRED EMBODIMENT

Figure 1:
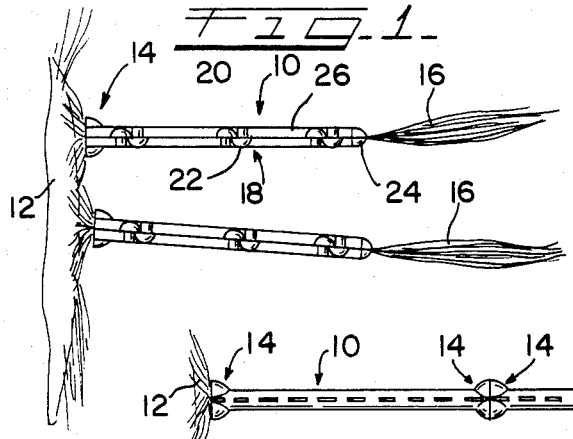
FIG. 1 is a front elevational view of adjacent hair styling props folded around hair strands and snap locked thereto adjacent the scalp.
Figure 2:
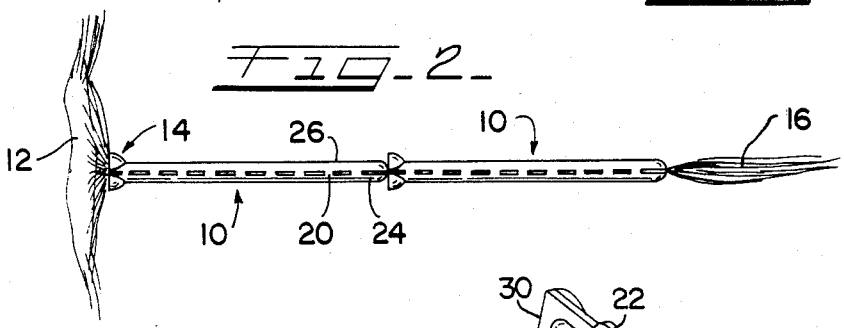
FIG. 2 is a rear elevational view of the hair styling prop showing the perforated living hinge, as well as the stackability of the styling prop.

The application of the present invention is best understood by first referring to FIGS. 1 and 2 of the drawings. The hair styling prop, generally designated 10, is preferably constructed of a lightweight plastic material to aid in supporting itself and strands of hair outwardly from the scalp 12 as shown in FIG. 1.

In accordance with the invention, the styling prop 10 includes a pair of elongate body member halves 24 and 26 serving as elements between which hair strands 16 are sandwiched and thereby captured. One body member half 24 is flexuously joined to the other body member half 26 by a perforated living hinge 21. The hinged halves 24 and 26 can then be opened and put around a lock of hair strands 16, and then closed together to captively hold the strands therebetween.

In keeping with the invention the hair styling prop 10 includes a snap-lock arrangement 18 comprising oppositely oriented and complementary shaped hemispherical nodules 20 and 22 attached to the respective free elongate edges of the hair prop body halves 24 and 26. When folding the body member halves 24 and 26 together around hair strands, the nodules 20 and 22 initially contact on camming surfaces and are thus flexibly urged apart slightly until they snap together and become engaged along a flat surface portion of each such nodule.

Figure 7:
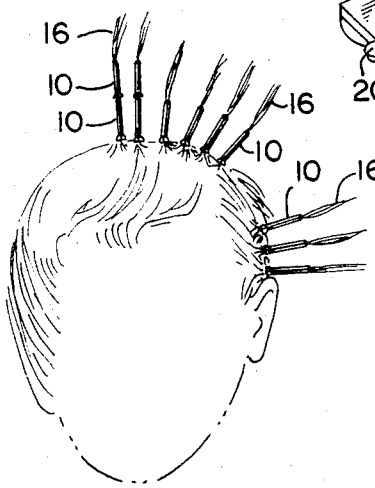
FIG. 7 illustrates the use of a plurality of hair styling props according to the invention.

Of particular significance, the invention includes a flanged base, generally designated 14, which increases the surface area of the hair styling prop base to prevent it and strands of hair 16 captively held therein, from falling downwardly onto other hair props (FIG. 7). In this manner, the ends of the hair strands 16 are isolated from other similarly situated hair strands and thus can be treated without the concern of styling fluids contaminating hair desired to remain untreated. Multiple hair props 10 can also be stacked together as shown in FIG. 2 to accommodate longer lengths of hair. Of course, the hair props themselves can be constructed with lengths corresponding to the length of hair to be styled.

Figure 3:
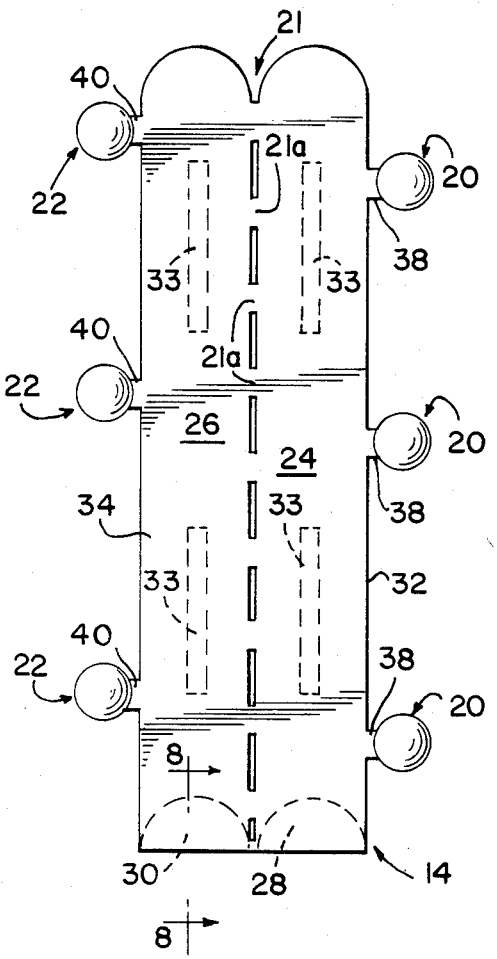
FIG. 3 is an outside plan view of the styling prop in an opened flat position.

In the unfolded open position, the styling prop 10 is shown in more detail in FIG. 3. The elongate body halves 24 and 26 are more clearly shown with the hemispherical locking elements 20 and 22 integrally disposed along respective elongate free edges 32 and 34, and with the perforated living hinge 21 flexuously joining such halves. For durability and weight considerations, the styling prop 10 is molded of a polypropylene or a polyethylene type of plastic. While other types of materials may be used with equal advantage, these types of materials are well adapted for constructing the entire prop 10, and especially the perforated hinge 21 which must remain reliable throughout a large number of flexing or folding movements.

Figure 4:
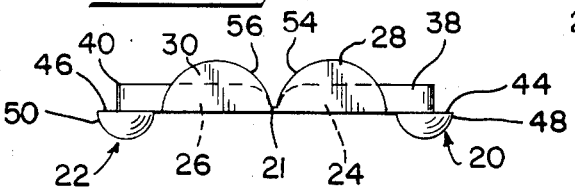
FIG. 4 is an end elevational view of the hair styling prop.

The perforated living hinge 21 includes a plurality of connecting segments **21*a* which permit the body member halves 24 and 26 to be more easily folded, as well as extend the life of the hinge 21. The spaced-apart hinge segments 21*a* facilitate the life of the hinge as the fatigue or breakage of one such segment 21*a* does not migrate to the other segments, and thus the body halves 24 and 26 are essentially connected by a plurality of individual living hinge segments. As noted in FIGS. 4 and 6 the living hinge 21 is formed or molded with a width such that the body member halves 24 and 26 are slightly separated, so that when folded to a closed position (FIG. 6) a space 36** separates the body halves to accommodate the strands of hair.

Figure 5:
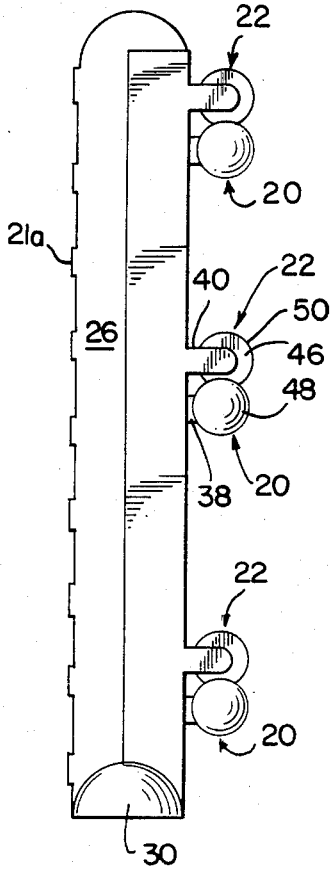
FIG. 5 is a top plan view of the styling prop in a folded snap-lock position.

In accordance with the snap-lock arrangement of the invention the hair styling prop 10 includes a plurality of hemispherical nodules 20 spaced along the free elongate edge 32 of body member half 24. Each snap-locking nodule 20 is formed integral with the body half 24 by a connecting stem 38 which flexibly joins the body member half 24 to the flat surface 44 (FIG. 4) of the hemispherical nodule 20. Hemispherical nodules 22 are comparably connected by stems 40 to the free elongate edge 34 of the other body member half 26. The ease with which the plurality of stems is formed is noted in FIG. 4 where the stems 38 and 40 are merely extensions of portions of the body member halves 24 and 26. As shown by FIG. 5, the connecting stems 38 and 40 are slender in width to permit slight lateral flexuous movement of the respective nodules 20 and 22 during snap-locking engagement.

It is also noted in FIG. 3 that each hemispherical nodule 20 on body member half 24 is axially displaced a small amount from a corresponding hemispherical nodule 22 on the other body member half 26. The axial displacement between corresponding hemispherical nodules 20 and 22 permit an individual snap-lock engagement between such corresponding nodules. With reference now to FIG. 5, corresponding hemispherical nodules 20 and 22 are shown axially displaced by an amount indicated by dimensional arrow 42. The connecting arrangement of the stem 40 to the hemispherical nodule 22 provides a flat engagement surface 46 which engages the flat engagement surface of the corresponding nodule 20 when the styling prop is folded to a fully closed position.

The snap-locking arrangement between corresponding hemispherical nodules 20 and 22 is effected during the folding of one body member half 24 toward the other half 26 as the curved or inclined camming surface of each corresponding hemisphere slideably engages and flexes the stems 38 and 40 apart slightly until the hemispherical nodule rims 48 and 50 slide "over center", whereby the stems 38 and 40 return to their natural unstressed position and the flat surfaces 44 and 46 become engaged. Because of the flat surface engagement of the snap-lock arrangement 18 strands of hair 16 are held tightly between the body member halves 24 and 26 which are prevented from being inadvertently disengaged. Intentional disengagement of the locking means is accomplished by simply applying a twisting force on the domed surfaces of a hemispherical nodule pair 20 and 22 until the flat surfaces of that nodule pair become disengaged. When one nodule pair becomes disengaged, the other nodule pairs will follow as the initial twisting force is generally sufficient to bow the body member halves 24 and 26 slightly apart so that the flat surfaces of the adjacent engaged nodule pairs slide apart and thus become disengaged. Because the styling hair prop is preferably constructed of a plastic material the flexibility of the body halves 24 and 26 afforded thereby permits easy disengagement of each snap lock pair in seriatim. A large force is thus not needed to simultaneously disengage all snap lock pairs at the same time.

As the hemispherical nodules 20 and stems 38 are constructed identical to the corresponding hemispherical nodules 22 and stems 40, the construction process by which the styling prop 10 is formed is facilitated. In other words, because the snap-lock arrangement is constructed of two identically formed elements the need to form two different elements, such as the traditional barb and aperture, is eliminated.

Optionally provided are apertures 33, shown in dashed lines in FIG. 3, for allowing air or styling fluid to permeate the hair within the styling prop 10. Any number and shape of apertures 33 may be chosen to achieve the desired amount of permeation.

Figure 8:
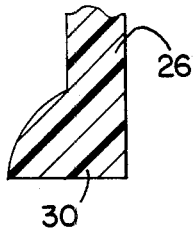
FIG. 8 is a partial sectional view of the hair styling prop illustrating the flanged base of one body member.
Figure 6:
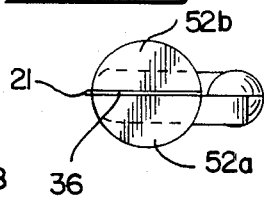
FIG. 6 is an end elevational view of FIG. 5.

Yet another feature of the invention is a base 14 which, when the hair prop 10 is folded onto hair strands 16 adjacent the scalp 12, permits the prop 10 to support the hair strands 16 radially outwardly from the scalp 12 (FIGS. 3 and 7). To that end, a flange 28 is formed at the end of body member 24 and is flared outwardly to form an enlarged surface area at such end. FIG. 8 shows the flange 30 extending radially outwardly from body member half 26. A flange 30 is comparably formed at the same end of body member half 26 such that when the member halves 24 and 26 are closed together an even larger base surface is formed as shown in FIG. 6. These enlarged flat base surfaces 52*a* and 52*b* form a foundation which supports the styling prop 10 on the scalp 12 and prevents movement of the prop 10, and thus the hair strands 16, with respect to the scalp 12. As noted above, this aspect advantageously permits the hair stylist to treat the hair strands 16 individually without the concern of one lock of hair dangling or hanging down and affecting other locks. Additionally, the diametric dimension of the base surfaces 52*a* and 52*b* can be selected such that desired spacings between adjacent styling props 10 can be automatically achieved. Where it is desired to space adjacent hair styling props further apart, the flanges 28 and 30 need only be flared outwardly to a greater extent.

Figure 9:
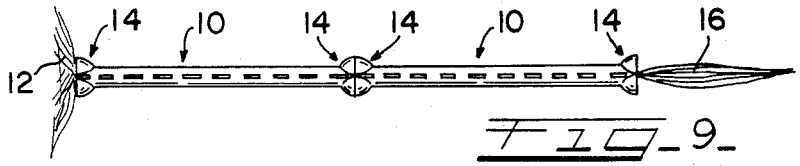
FIG. 9 is an elevational view of an alternative form of the invention illustrating a flanged base at each end of the hair styling prop.

FIG. 9 illustrates a variation of the hair styling prop having a flanged base 14 formed at each end thereof. This aspect not only provides a base for supporting the first hair prop outwardly from the scalp 12, but also provides a base for supporting multiple props outwardly when stacked against each other on a lock of hair strands 16.

Another advantage flowing from the flanges 28 and 30 is that an interference is created therebetween when the body member halves 24 and 26 are attempted to be folded in the wrong direction. This is an aid to the hair dresser as the direction of rotational closing movement can be quickly determined without visibly looking at the device. A rotational closing movement in the wrong direction is detected in a short rotational arc of the body member halves 24 and 26 as the peripheral edge 54 of flange 28 abutts the peripheral edge 56 of flange 30 (FIG. 4) and prevents further rotational movement in the wrong direction.

Figure 10:
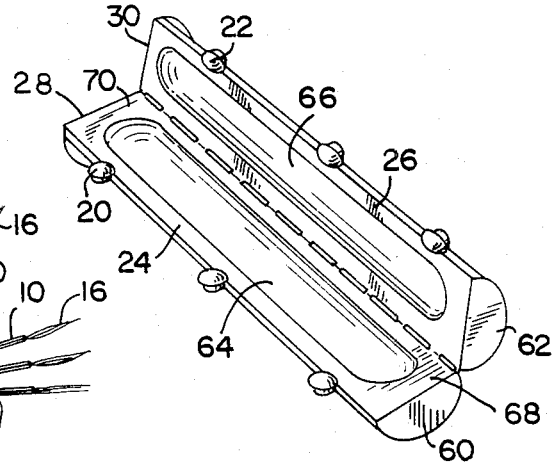
FIG. 10 is an isometric view of the hair styling prop of FIG. 9 showing the concave depressions within the inner faces of the body member halves.

In some applications of the invention an elongate groove 64 (FIG. 10) may be formed into the inner face of one body member half 24. The grooved area 64 serves as a pocket to hold the hair strands as well as adequate styling fluid and thus assures that the hair strands become well saturated. While the groove 64 shown in FIG. 10 does not extend throughout the length of the body member half 24, which of course it could, the bridging ends 68 and 70 aid in clamping the hair strands 16 within the hair prop 10 when the body member halves 24 and 26 are snap locked together. Groove 66 is comparably formed into body member half 26.

It is seen from the foregoing that an inexpensive, but highly advantageous hair styling device is provided. The ease with which the styling device is used with strands of hair is underscored by its ability to be installed quickly and easily with the index finger and thumb of one hand, thereby permitting the operator to use the other hand to select and hold the strands of hair.

Since various modifications to the device described herein are undoubtedly possible by those skilled in the art without departing from the scope and spirit of the invention, the detailed description is to be considered illustrative and not restrictive of the invention as claimed hereinbelow.

What is claimed is:

1. A one-piece plastic hair styling device comprising: a pair of substantially identical elongate body member halves hingedly connected together along one edge thereof and movable toward each other from an open position to a closed position to capture a plurality of treated hair strands therebetween in isolation from untreated hair, a plurality of snap-lock means along the free edges of said halves which include a first plurality of spaced apart stems extending perpendicularly outwardly from one elongate edge of said body member half, a corresponding second plurality of spaced apart stems extending perpendicularly outwardly from the other elongate edge of said body member half, each stem of said second plurality of stems being axially offset with respect to each corresponding stem of said first plurality of stems, whereby each stem of said first plurality of stems is paired with a different corresponding stem of said second plurality of stems when one elongate body half is hingeably pivoted toward the other elongate body half, a plurality of nodules having a hemispherical surface and a flat surface, said flat surface being attached to the outer end of each stem and disposed thereon so that when said body member halves are hingeably pivoted, nodules attached to paired stems initially cammingly engage each other along the hemispherical surfaces causing the stems to flex the nodules from a rest state away from each other and then toward each other to the rest state so the flat surfaces of said nodules lockingly engage when said body member halves are pivoted to a closed position.

2. The styling device of claim 1, wherein said snap-lock means are spaced apart sufficiently such that one snap-lock means is operative to be disengaged without disengaging the remaining snap-lock means.

3. The hair styling device of claim 1, further including a base integrally molded to each said body member half at an end thereof, said base protruding radially outwardly from said body member halves so that when said device is used at the root ends of said hair the base contacts the scalp and supports the device and the hair strands outwardly from said scalp.

4. The hair styling device of claim 1, wherein each said body member half includes an aperture therein for transfer of air to the strand of hair contained within said hair styling device when closed.

5. The hair styling device of claim 1, further including a groove disposed within the inside face of at least one body member half for accommodating their strands therein.

6. The styling device of claim 1, wherein each said elongate body member half half is of such cross-sectional shape as to permit a bowing along the free elongate edges thereof during disengagement and allow disengagement of one engaging locking means of said plurality without disengagement of the remaining engaging locking means of said plurality.

7. The hair styling device of claim 3, wherein the distal end of said base is flat.

8. The hair styling device of claim 2, further including a base at each end of said device.

9. The hair styling device of claim 7, wherein the flat surface of said base end of said device is generally semicircular in shape so that when each said body member half is snap-locked together it provides a circular flat surface area.

10. The hair styling device of claim 5, further including means for clamping said hair strands within said device when said body member halves are snap locked together.

* * * * *